United States Patent [19]

Prest

[11] Patent Number: 4,791,538

[45] Date of Patent: Dec. 13, 1988

[54] TRIPOD LANTERN STAND

[76] Inventor: John D. Prest, 1314 5th Ave., Yuma, Ariz. 85362

[21] Appl. No.: 147,305

[22] Filed: Jan. 22, 1988

[51] Int. Cl.[4] ..... F21L 19/00

[52] U.S. Cl. ..... 362/159; 362/160; 362/190; 126/39 R; 431/110; 431/344

[58] Field of Search ..... 362/160, 159, 190, 191, 362/381; 431/344, 343, 110, 111; 126/39 R, 38, 41 R

[56] References Cited

U.S. PATENT DOCUMENTS

| | | | |
|---|---|---|---|
| 2,796,573 | 2/1954 | Altes | 318/343 |
| 3,405,703 | 10/1968 | Axelsson et al. | 126/38 |
| 3,809,054 | 5/1974 | Bowman et al. | 126/38 |
| 3,933,146 | 1/1976 | Hastings | 126/38 |
| 4,149,225 | 4/1979 | Barson | 362/160 |

*Primary Examiner*—Michael Koozo
*Assistant Examiner*—Sue Hagarman
*Attorney, Agent, or Firm*—Cahill, Sutton & Thomas

[57] ABSTRACT

Three cylinders containing a combustible gas under pressure are interchangeably attached to a lantern supporting stanchion to serve as a tripod stand for the lantern and provide a source of fuel for the lantern from one of the locations of attachment.

17 Claims, 1 Drawing Sheet

TRIPOD LANTERN STAND

BACKGROUND OF THE INVENTION

1. Field of the Invention

The present invention relates to a portable gas fired apparatus and, more particularly, to a gas fired apparatus having a stand of a plurality of gas storage cylinders.

2. Description of the Prior Art

Lanterns which generate light through combustion of a gaseous fuel have been available in one configuration or another for decades. For domestic and particularly sporting uses, such lanterns include apparatus for tapping an attached container of gaseous fuel under pressure. Generally, the cylinder is detachably attached and serves as a stand or base for the lantern. A guard may be incorporated to shield an attached cylinder against transmission of heat from the lantern and prevent a potentially dangerous temperature rise of the cylinder; a example of such lantern is described and illustrated in U.S. Pat. No. 2,796,573.

A lantern assembly, including a repositionable handle, is detachably attachable to a gas cylinder serving as a base, as illustrated and described in U.S. Pat. No. 4,149,225. A ventilated shade usable with a lantern apparatus which extends upwardly from a gas cylinder is illustrated in U.S. Pat. No. 4,321,656. A gas cylinder supported lantern apparatus having an encircling transparent wind guard disposed between upper and lower members is discussed in Canadian Pat. No. 974,214. In each of the above described gas fired lanterns, little, if any, warning is provided of the pending depletion of the gaseous fuel in the gas cylinder. To ensure against untimely depletion of fuel, a user must have available a replacement filled cylinder.

As a practical matter, almost no gas fired lantern user keeps track of the number of hours of use of the lantern and thereby be able to determine the state of depletion of the gas cylinder. And, the cylinder is seldom weighed with sufficient accuracy to permit a determination of the quantity of gas remaining. For these reasons,it is not unusual to deplete the source of fuel for the lantern at the most awkward or inconvenient moment. Because of the inconvenience and nuisance of transporting a spare replacement gas cylinder, it is seldom included as part of the supplies for a camping trip or excursion unless a clear indication exists that it will be needed. Also, it is sometimes forgotten and left behind.

SUMMARY OF THE INVENTION

Three detachably attached cylinders containing a combustible gas under pressure are interchangeably attached to a stanchion supported gas fired apparatus, such as a lantern, to serve as a tripod stand for the gas fired apparatus. Two of the cylinders provide a reserve source of gas and the third cylinder is in fluid communication with the gas fired apparatus. Upon depletion of the cylinder in use, it may be interchanged with one of the remaining gas filled cylinders to continue providing a source of gas fired apparatus. Depleted cylinders may be replaced when convenient.

It is therefore a primary object of the present invention to provide a self contained gas fired apparatus having replacement gas cylinders formed as a part thereof.

Another object of the present invention is to provide apparatus for incorporating spare gas filled cylinders as structural elements of a gas fired apparatus.

Still another object of the present invention is to provide a self contained lantern having a plurality of serially depletable sources of fuel.

Yet another object of the present invention is to provide apparatus for supporting a gas fired lantern upon a plurality of gas filled cylinders.

A further object of the present invention is to provide a tripod formed of gas cylinders for supporting and providing fuel for a gas fired lantern.

A still further object of the present invention is to provide apparatus for serially tapping a plurality of gas cylinders, which gas cylinders as a unit provide support for an attached gas fired lantern.

A yet further object of the present invention is to provide a gas fired apparatus supported upon a tripod formed of three supporting gas cylinders, only one of which is in fluid communication with the apparatus.

These and other objects of the present invention will become apparent to those skilled in the art as the description thereof proceeds.

BRIEF DESCRIPTION OF THE DRAWINGS

The present invention may be described with greater specificity and clarity with reference to the following drawings, in which.

DETAILED DESCRIPTION OF THE INVENTION

Figure 1:
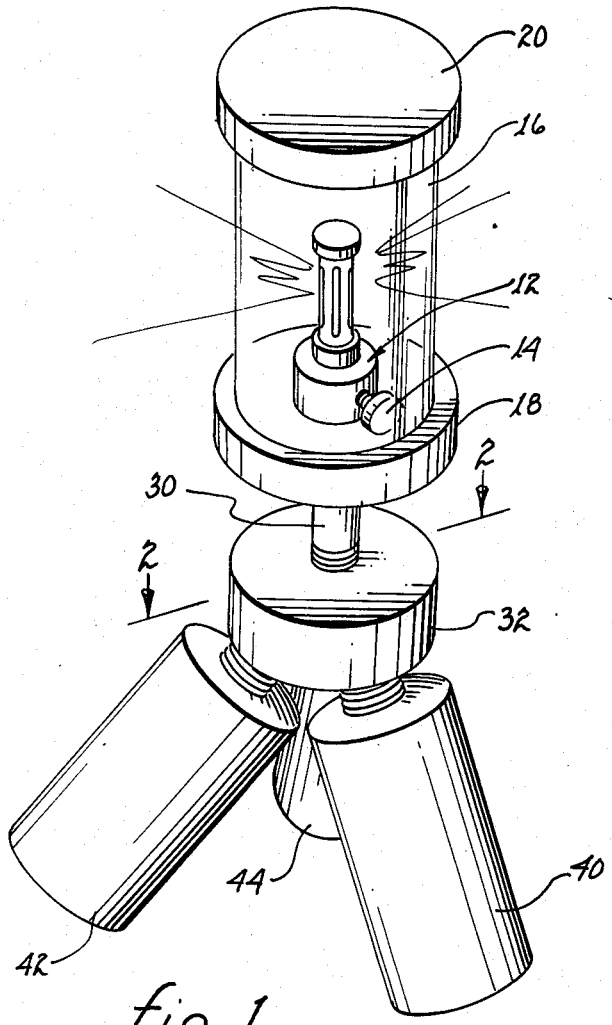
FIG. 1 is a perspective view of the present invention.

Referring to FIG. 1 there is shown a lantern 10 having a burner apparatus 12 for converting a combustible gas into a source of visible light. Regulating means 14 may be employed to control the burn rate of the gas with a commensurate control of light emitted. A transparent cylindrical wind shield 16 is supported upon a base 18. A top 20 is disposed at the upper end of shield 16.

Figure 2:
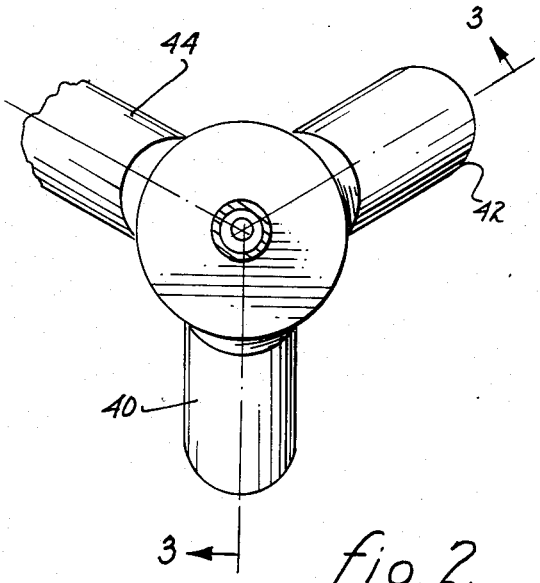
FIG. 2 is a top view taken along lines 2—2, as shown in FIG. 1.
Figure 3:
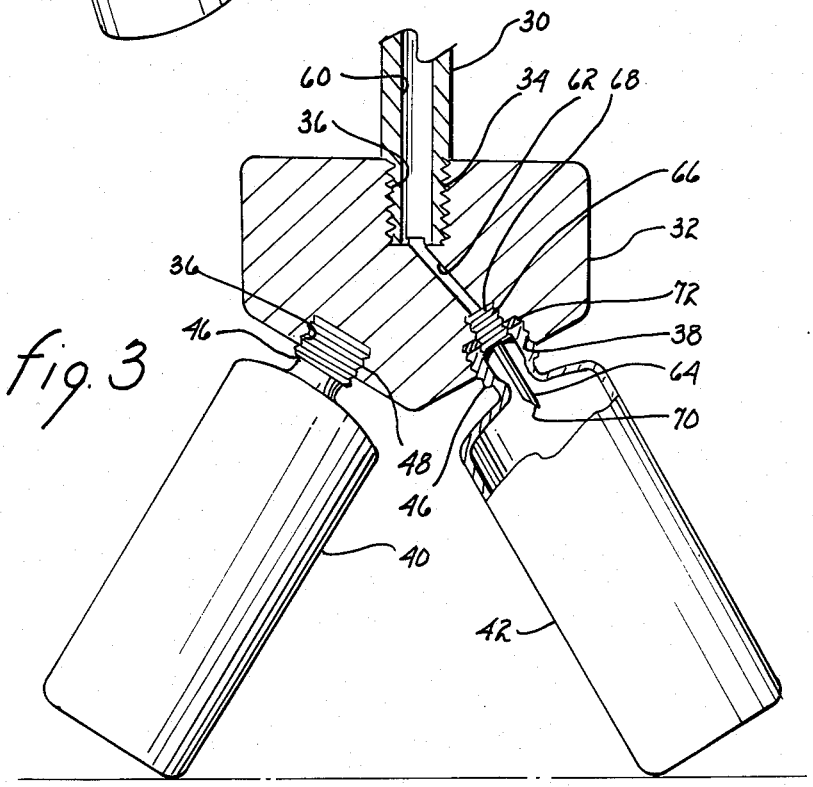
FIG. 3 is a partial cross sectional view taken along lines 3—3, as shown in FIG. 2.

Referring jointly to FIGS. 1, 2 and 3, the details for conveying a combustible gas to burner apparatus 12 will be described. A stanchion 30 depends from base 18 to support the burner apparatus and associated elements. The stanchion is supported by and extends upwardly from pedestal 32. The interconnection between the stanchion and the pedestal may be threaded cavity 36 and threaded means 34 of the stanchion, as illustrated. Pedestal 32 includes three threaded cavities opening downwardly, of which two cavities, 36, 38, are shown in FIG. 3. Each of these three cavities is in threaded engagement with one of gas cylinders 40, 42 and 44. Each of the gas cylinders includes a neck portion 46 having threads 48 disposed thereon for threaded engagement with the respective one of the three cavities in the pedestal. Upon threaded engagement of each of gas cylinders 40, 42, 44 with pedestal 32, a tripod is formed. This tripod serves as a stand for stanchion 30 and the attached burner apparatus associated therewith.

Stanchion 30 includes an internal passageway 60 for conveying the flow of combustible gas to burner apparatus 12 from cavity 36. A passageway 62 is disposed within pedestal 32 in fluid communication with cavity 36. An hollow needle or stem 64 extends from within cavity 38. The point of attachment of the stem may be by means of a threaded boss 68 in threaded engagement with a like configured annularly expanded portion 66 of passageway 62. Boss 66 is configured to permit fluid communication between passageway 62 and inlet 70 of hollow stem 64.

Commercially available gas containers, as depicted by numerals 40, 42, 44, may include a puncturable seal extending across neck 46. Upon engagement of gas cylinder 42 with cavity 38, hollow stem 64 will puncture the seal of the gas cylinder to permit a flow of gas from within the gas cylinder into passageway 62. To minimize gas leakage about the perimeter of neck 46, an annular gasket 72 may be disposed within cavity 38 to bear against the terminal perimeter of the neck. Gas flow from within the cylinder secured to cavity 38 is controlled and regulated by regulating means 14, or the like.

In operation, until the contents are exhausted, gas cylinder 42 will provide a source of combustible gas to burner apparatus 12. Thereafter, gas cylinder 42 may be disengaged with cavity 38 and interchanged with one of gas cylinders 40, 44, whichever one still has gas therein. Upon exhaustion of the gas within the initially interchanged gas cylinder, the third gas cylinder may be interchanged, assuming it contains gas. During intermediate periods of use of lantern 10, any of the gas cylinders which has previously been depleted may be interchanged with a full gas cylinder.

From the above description of use of the present invention, it will become apparent that lantern 10 includes it's own reserve of gas for burner apparatus 12. Moreover, adequate notice is provided by depletion of the gas within the cylinder in use while the capability for continuing operation of lantern 10 exists through the simple expedient of interchanging gas cylinders.

It is to be understood that the gas fired apparatus may be a burner for cooking or heating. In the event it is a burner for cooking, care must be taken to assure that the stanchion, or its equivalent, and the pedestal, or its equivalent, are sufficiently robust to support the weight of the pots or pans and their contents which may be placed thereupon.

Aside from providing a source of combustible gas, the three gas cylinders provide support in the manner of a tripod for the burner apparatus. This tripod configuration permits placement of the gas fired apparatus upon uneven surfaces with minimal danger of tipping. As will be particularly noted from the figures, the three gas cylinders are angled downwardly and outwardly. Accordingly, the points of contact upon a supporting surface represent a relatively wide stance which will stabilize the gas gired apparatus to a much greater degree than if the gas fired apparatus were supported by the base of a single gas cylinder, as is common in the prior art. Upon even cursory analysis, it will become evident that the gas cylinders, whether full or empty, continue to have a utilitarian purpose.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A support for a gas fired apparatus, said support comprising in combination:

(a) a pedestal;

(b) means extending from said pedestal to the gas fired apparatus for supporting the gas fired apparatus and for conveying a flow of gas to the gas fired apparatus;

(c) means associated with said pedestal for engaging in a depending relationship each of three detachably attachable gas cylinders, said supporting means, in combination with the gas cylinders, defining a tripod support of the gas fired apparatus; and (d) said engaging means including means for establishing fluid communication between said conveying means and a selected one of the gas cylinders to provide a flow of gas from the selected gas cylinder to the gas fired apparatus.

2. The support as set forth in claim 1 wherein each of the gas cylinders includes a neck and wherein said engaging means includes means for securing the neck of each of the gas cylinders.

3. The support as set forth in claim 2 wherein each of the gas cylinders includes a puncturable seal and wherein said establishing means includes an hollow stem for puncturing the seal.

4. The support as set forth in claim 3 wherein said securing means includes seal means.

5. The support as set forth in claim 1 wherein said engaging means includes three cavities, each of said cavities being adapted to support one of the three gas cylinders.

6. The support as set forth in claim 5 wherein said three cavities are equidistant from one another.

7. The support as set forth in claim 5 wherein said three cavities orient the supported gas cylinders outwardly and equiangularly spaced from one another.

8. The support as set forth in claim 7 wherein each gas cylinder incudes a threaded neck and wherein each of said cavities includes threads for threadedly securing the neck of the respective one of the gas cylinders.

9. The support as set forth in claim 8 wherein each of the gas cylinders includes a puncturable seal and wherein said establishing means includes an hollow stem for puncturing the seal.

10. A gas fired lantern, said lantern comprising in combination:

(a) gas fired apparatus for emitting visible light;

(b) a pedestal, said pedestal including a passageway for conveying gas;

(c) a stanchion extending from said pedestal for supporting said gas fired apparatus and for conveying a flow of gas from said passageway to said gas fired apparatus;

(d) means for disengagably engaging each of three gas cylinders with said pedestal, which gas cylinders serve as a tripod to support said pedestal, said engaging means being adapted to permit an interchange and replacement of the gas cylinders; and (e) said engaging means including means for channeling gas from within one of the gas cylinders attached to said pedestal to said passageway within said pedestal.

11. The lantern as set forth in claim 10 wherein each of the gas cylinders includes a neck and wherein said engaging means includes means for securing the neck of each of the gas cylinders.

12. The lantern as set forth in claim 11 wherein each of the gas cylinders includes a puncturable seal and wherein said channeling means includes an hollow stem for puncturing the seal.

13. A gas fired lantern, said lantern comprising in combination:

(a) gas fired apparatus for emitting visible light;

(b) a pedestal, said pedestal including a passageway for conveying gas;

(c) a stanchion extending from said pedestal for supporting said gas fired apparatus and for conveying a flow of gas from said passageway to said gas burning apparatus;

(d) three gas cylinders;

(e) means for disengagably engaging each of said gas cylinders with said pedestal to establish a tripod support for said pedestal; and (f) said engaging means including means for channeling gas from within one of said gas cylinders to said passageway.

14. The lantern as set forth in claim 13 wherein said engaging means includes three cavities and wherein each of said gas cylinders includes a neck for engaging one of said cavities.

15. The lantern as set forth in claim 14 wherein each of said cavities is threaded and wherein each said neck is threadedly engagable with one of said cavities.

16. The lantern as set forth in claim 14 wherein said three cavities are equidistant from one another.

17. The lantern as set forth in claim 16 wherein said three cavities orient said engaged gas cylinders outwardly equiangularly.

* * * * *